US010081095B1

(12) United States Patent
Lee

(10) Patent No.: US 10,081,095 B1
(45) Date of Patent: Sep. 25, 2018

(54) TABLEWARE HANDLE

(71) Applicant: Kolor Magnetic (Shenzhen) Co., Ltd., Shenzhen, Guangdong (CN)

(72) Inventor: Ching Mou Lee, Guangdong (CN)

(73) Assignee: Kolor Magnetic (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 15/604,709

(22) Filed: May 25, 2017

(30) Foreign Application Priority Data

Mar. 23, 2017 (CN) ..... 2017 2 0292894 U

(51) Int. Cl.

| | |
|---|---|
| ***A47G 21/02*** | (2006.01) |
| ***B26B 3/02*** | (2006.01) |
| ***A47G 21/04*** | (2006.01) |
| ***B25G 1/10*** | (2006.01) |
| ***A47G 21/00*** | (2006.01) |

(52) U.S. Cl.
CPC ..... *B25G 1/10* (2013.01); *A47G 21/00* (2013.01); *A47G 21/02* (2013.01); *A47G 21/04* (2013.01); *A47G 2400/10* (2013.01); *B26B 3/02* (2013.01)

(58) Field of Classification Search
CPC ..... A47G 21/02; A47G 21/04; A47G 21/06; B26B 3/02
See application file for complete search history.

(56) References Cited

U.S. PATENT DOCUMENTS

| | | | | | |
|---|---|---|---|---|---|
| D178,086 | S | * | 6/1956 | Riedener | D7/653 |
| 2,752,678 | A | * | 7/1956 | Welch | A47G 21/04 206/499 |
| D238,847 | S | * | 2/1976 | Manderfield | D7/653 |
| D271,267 | S | * | 11/1983 | Cassini | D7/653 |
| 4,524,512 | A | * | 6/1985 | Formo | A47G 21/06 30/147 |
| D299,899 | S | * | 2/1989 | Liebmann | D7/653 |
| 5,388,600 | A | * | 2/1995 | Hart | A61C 15/046 132/323 |
| 5,904,250 | A | * | 5/1999 | De Schutter | B65D 71/00 206/553 |
| D533,034 | S | * | 12/2006 | Wasserman | D7/653 |
| 8,296,957 | B2 | * | 10/2012 | Muehlemann | A47G 21/02 30/142 |
| D758,141 | S | * | 6/2016 | Spagnolo | D7/642 |

(Continued)

FOREIGN PATENT DOCUMENTS

| | | | |
|---|---|---|---|
| EP | 1 514 497 | A1 * | 3/2005 |
| WO | WO 2017/176918 | A1 * | 10/2017 |

*Primary Examiner* — Hwei C Payer

(57) ABSTRACT

A tableware handle which comprising a handle body and a reinforcing rib, is provided. The handle body has a rod shape and comprises a first surface, and a second surface respectively connected at both side edges of the first surface. Two of the second surfaces form an opened opening. The handle body further comprises a third surface connected at a side edge of an opened end of the second surface. The second surface and the third surface are bent at a transition zone therebetween to form a trapezoidal stepped cross section of the handle body. The tableware handle is designed to have a superimposed trapezoidal shape, which facilitates the holding of the tableware during using, enhances the strength of the handle, and meanwhile makes it easy to stack the tableware when storing or packaging.

4 Claims, 3 Drawing Sheets

(56) References Cited

U.S. PATENT DOCUMENTS

| | | | | |
|---|---|---|---|---|
| 2012/0297628 | A1* | 11/2012 | Rayko | A47G 21/02<br>30/123 |
| 2016/0374488 | A1* | 12/2016 | Shapiro | A47G 21/023<br>30/165 |
| 2017/0095100 | A1* | 4/2017 | White | A47G 21/02 |
| 2017/0340152 | A1* | 11/2017 | Lee | A47G 21/02 |

* cited by examiner

TABLEWARE HANDLE

CROSS REFERENCE TO RELATED APPLICATIONS

The present application claims the benefit of Chinese Patent Application No. 201720292894.5 filed on Mar. 23, 2017. All the above are hereby incorporated by reference.

TECHNICAL FIELD

The present disclosure relates generally to tableware, and more particularly, to tableware handle.

BACKGROUND

The portable tableware has been widely used in the daily life. The plastic knife, fork, spoon are required during the travelling. Comparing with metal or wood ones, the plastic tableware is lighter to facilitate carrying and using. The existing plastic tableware normally has a straight handle, which is often deformed or even damaged during the use due to the material properties. Meanwhile, problems such as being easy to loose, inconvenient to stack, and so on, often come out when packaging or storing such plastic tableware.

SUMMARY

The object of the present application is to provide a tableware handle which is lighter and thinner than the common seen plastic tableware handle while having a strong strength, and is easy to stack, use and store as well, aiming at the above defects of the prior art.

In one aspect, a tableware handle which comprising a handle body and a reinforcing rib, is provided. The handle body has a rod shape and comprises a first surface, and a second surface respectively connected at both side edges of the first surface. Two of the second surfaces form an opened opening. The handle body further comprises a third surface connected at a side edge of an opened end of the second surface. The second surface and the third surface are bent at a transition zone therebetween to form a trapezoidal stepped cross section of the handle body.

The reinforcing rib being rhombuses intertwined together as a whole is provided at bottom of the first surface.

Furthermore, a reinforcing column is provided at an inner side of the third surface.

Furthermore, the reinforcing column is a square or semi-circular cylinder.

Furthermore, the reinforcing rib is a circular or square protrusion.

Furthermore, the handle body, the reinforcing column and the reinforcing rib are made of plastic materials.

Furthermore, an end of the handle body has an inclined section.

Furthermore, the handle body has arc-shaped edges and corners.

There are several advantages of the implementation of the tableware handle according to the present application. The tableware handle is designed to have a superimposed trapezoidal shape, which facilitates the holding of the tableware during using, enhances the strength of the handle, and meanwhile makes it easy to stack the tableware when storing or packaging. In such a way, the stacking of the tableware becomes tighter and steadier, and is not easy to be scattered. In additional, as the reinforcing rib is provided on the tableware handle, the strength of the tableware handle is improved on the basis of material reduction. In such a way, the whole tableware is thinner and lighter, and meanwhile the deformation or damage during using can also be prevented.

BRIEF DESCRIPTION OF THE DRAWINGS

The present application is further illustrated combining the embodiments and drawings attached.

DETAILED DESCRIPTION OF THE PREFERRED EMBODIMENT

Figure 1:
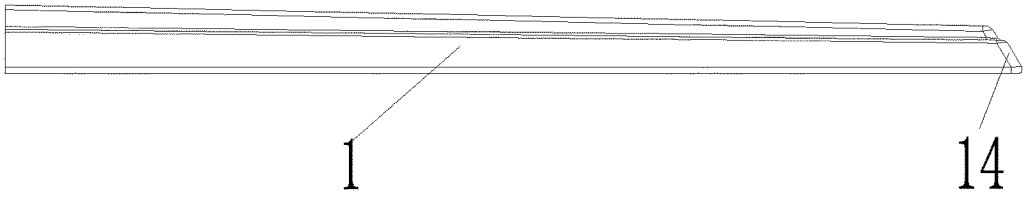
FIG. 1 is a diagrammatic view showing the structure of the tableware handle in accordance with the present application.
Figure 2:
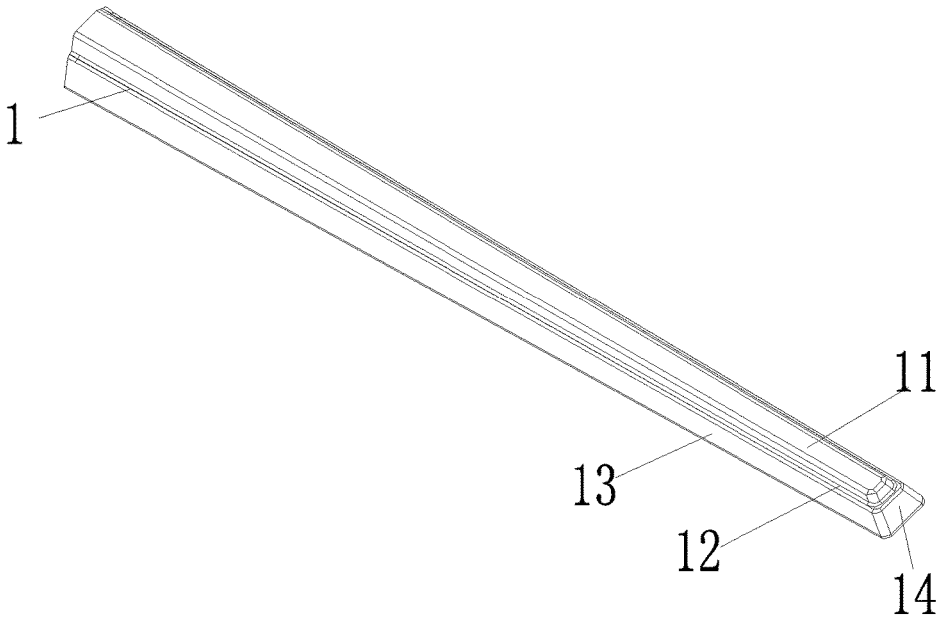
FIG. 2 is a front view showing the stereostructure of the tableware handle in accordance with the present application.
Figure 3:
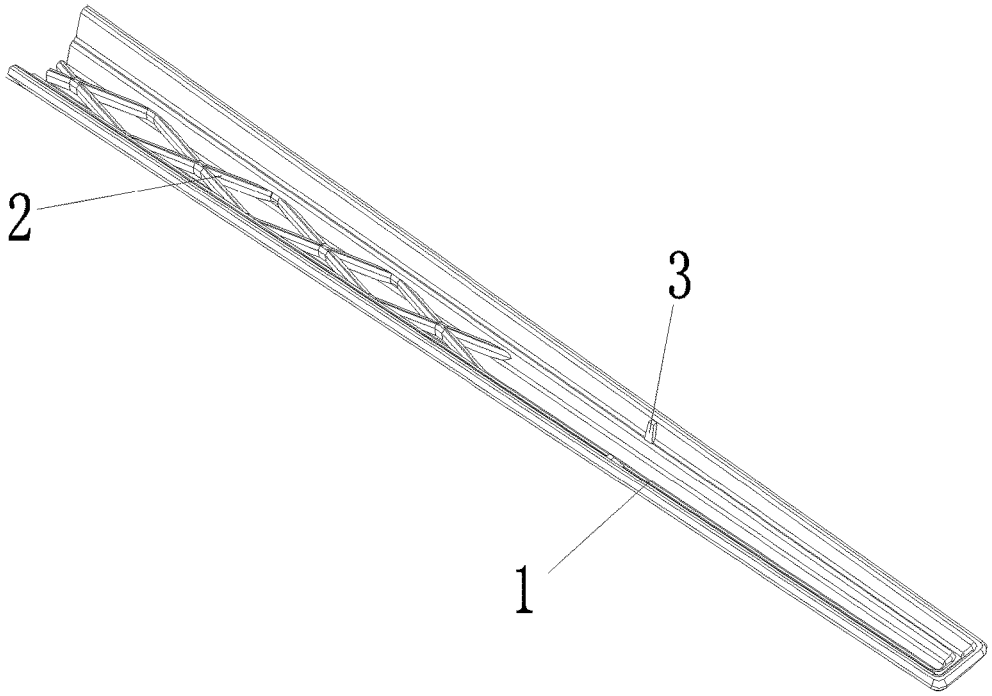
FIG. 3 is a back view showing the stereostructure of the tableware handle in accordance with the present application.
Figure 4:
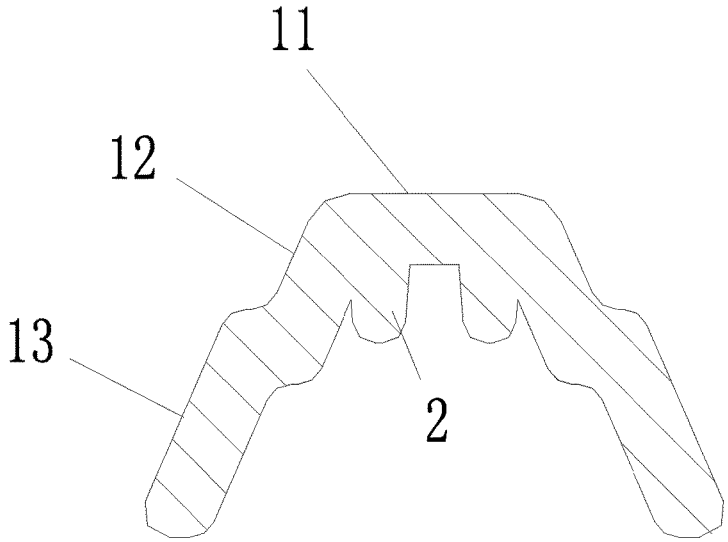
FIG. 4 is a cross-section view showing the tableware handle in accordance with the present application.
Figure 5:
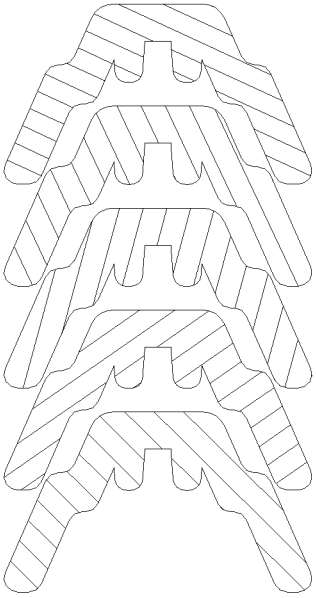
FIG. 5 is a diagrammatic view showing the tableware handle in accordance with the present application overlapping together.
Figure 6:
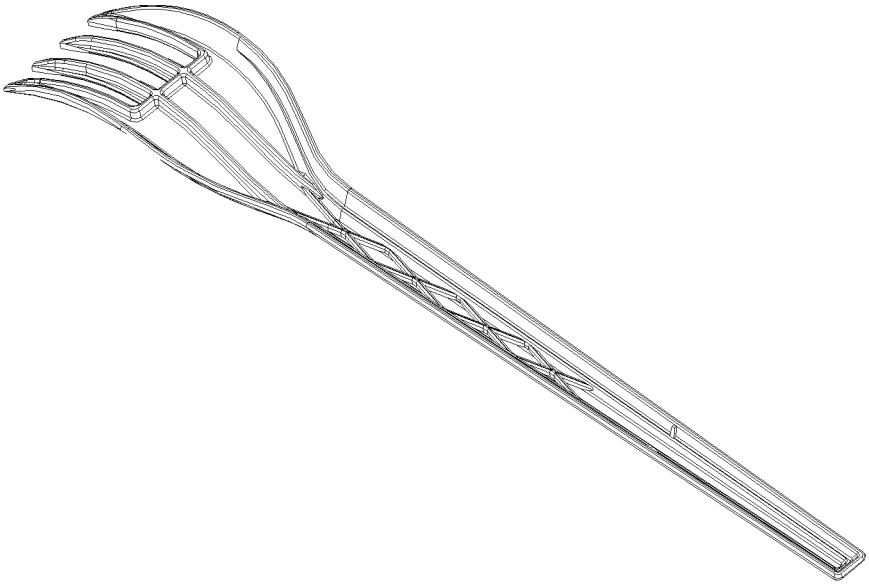
FIG. 6 is a diagrammatic view showing the tableware handle in accordance with the present application applying to a fork.

FIGS. 1-6 have shown the tableware handle in accordance with an preferable embodiment of the present application, which tableware handle comprises a handle body 1 having a rod shape and a reinforcing rib 2. The handle body 1 comprises a first surface 11, two second surfaces 12 respectively connected at both side edges of the first surface 11, and a third surface 13. Two of the second surfaces 12 form an opened opening and the third surface 13 is connected at the side edge of the opened end of the second surfaces 12. The second surface 12 and the third surface 13 are bent at a transition zone therebetween to form a trapezoidal stepped cross section of the handle body 1. The reinforcing rib 2 comprises rhombuses intertwined together as a whole and is provided at bottom of the first surface 11. When using the tableware, the handle body 1 is held by the user's hand, while the reinforcing rib 2 can further be used for improving the strength of the handle body 1. In the present embodiment, the handle body 1 is designed as a superimposed trapezoid, which increases the contacting area when holding the handle body, enhances the strength of the handle body 1, and facilitates the using. Meanwhile, the handle body 1 is thinner and lighter which reduces production material and makes the tableware more portable. In such a way, the tableware can be stacked during the storage. As shown in FIG. 5, the tableware handle of one tableware can be placed into the tableware handle of another tableware, such that the stacking of the tableware becomes tighter and steadier, and is not easy to be scattered. In order to strengthen the strength of the handle body 1, the bottom of the first surface 11 is provided with reinforcing ribs 2 which are elongated projections. The reinforcing ribs 2 can be arranged laterally or inclined. Preferably, the reinforcing rib 2 can be rhombuses intertwined together as a whole, which can have a larger coverage surface to strengthen the strength of the handle body 1 both on the transverse and vertical directions. In such a way, the strength of the handle body can be effectively enhanced.

In the present embodiment, a reinforcing column 3 is provided at the inner side of the third surface 13. As the reinforcing rib 2 is arranged on the top of the handle body 1, the strength of the third surface 13 should also be improved. Accordingly, the reinforcing column 3 is provided at the inner side of the third surface 13. The reinforcing column 3 is a square prism used for improving the strength of the third surface 13.

In the present embodiment, the handle body 1, the reinforcing column 3 and the reinforcing rib 2 are made of plastic materials. The plastic tableware has a light weight, so it is easy to be carried and transported. Meanwhile, the cost for plastic tableware is less, and is suitable for some specific occasions.

In the present embodiment, the end 14 of the handle body 1 has an inclined section. As the end 14 of the handle body 1 is designed to have an inclined section, so it firstly becomes easy to stack the tableware during the storage, which makes the storage more convenient and not easy to be scattered. Secondly, the edge of the inclined surface is not as sharp as the right angle, which may prevent the user from being scratched.

In the present embodiment, the handle body 1 has arc-shaped edges and corners. In order to prevent the user from being scratched by the sharp edges and corners, all the edges and corners of the handle body 1 have arc transitions. There are several advantages of the implementation of the tableware handle according to the present application. The tableware handle is designed to have a superimposed trapezoidal shape, which facilitates the holding of the tableware during using, enhances the strength of the handle, and meanwhile makes it easy to stack the tableware when storing or packaging. In such a way, the stacking of the tableware becomes tighter and steadier, and is not easy to be scattered. In additional, as the reinforcing rib is provided on the tableware handle, the strength of the tableware handle is improved on the basis of material reduction. In such a way, the whole tableware is thinner and lighter, and meanwhile the deformation or damage during using can also be prevented.

The foregoing is a further detailed description of the present application in connection with specific preferred embodiments, and cannot be considered as that the specific implementation of the present application is limited to these illustrations. It will be apparent to those skilled in the art that any various modifications or substitutions may be made to the present application without departing from the spirit of the invention, and such modifications or substitutions should be considered as falling within the scope of the present application.

What is claimed is:

1. A tableware handle comprising a handle body and a reinforcing rib, wherein the handle body has a rod shape and comprises one first surface, two second surfaces, and two third surfaces, wherein the two second surfaces are respectively connected at both side edges of the first surface, wherein the two second surfaces form an opened opening; each of the two third surfaces is connected at one side edge of an opened end of a respective one of the two second surfaces which is away from the first surface, wherein the second surfaces and the third surfaces are bent at a transition zone therebetween and the third surfaces flare outwardly to form a trapezoidal stepped cross section of the handle body;

the reinforcing rib being rhombuses intertwined together as a whole is provided at a bottom of the first surface; wherein the reinforcing rib is an elongated projection; a reinforcing column is provided at an inner side of at least one of the third surfaces; an end of the handle body has an inclined section.

2. The tableware handle according to claim 1, wherein the reinforcing column is a square prism.

3. The tableware handle according to claim 1, wherein the handle body, the reinforcing column and the reinforcing rib are made of plastic materials.

4. The tableware handle according to claim 1, wherein the handle body has arc-shaped edges and corners.

* * * * *